US008578541B2

(12) United States Patent
Bennett

(10) Patent No.: US 8,578,541 B2
(45) Date of Patent: Nov. 12, 2013

(54) SHOE CLEANING DEVICE

(76) Inventor: Jethro Bennett, Cambridge (GB)

( * ) Notice: Subject to any disclaimer, the term of this patent is extended or adjusted under 35 U.S.C. 154(b) by 0 days.

(21) Appl. No.: 13/273,005

(22) Filed: Oct. 13, 2011

(65) Prior Publication Data

US 2013/0091646 A1 Apr. 18, 2013

(30) Foreign Application Priority Data

Oct. 14, 2010 (GB) ..... 1017367.2
Aug. 4, 2011 (GB) ..... 1113439.2

(51) Int. Cl.
*A47L 17/04* (2006.01)
*A47L 23/04* (2006.01)

(52) U.S. Cl.
USPC ..... 15/97.2; 15/93.1; 15/236.1; 15/28; 15/3; 29/428

(58) Field of Classification Search
USPC ..... 15/97.2
See application file for complete search history.

(56) References Cited

U.S. PATENT DOCUMENTS 3,378,869 A * 4/1968 Schwartz ..... 15/93.1

* cited by examiner

*Primary Examiner* — Monica Carter
*Assistant Examiner* — Stephanie Berry

(57) ABSTRACT

A shoe cleaning device 10 comprises a rotatable cleaning disc 12, a housing 14 on which the cleaning disc 12 is rotatably mountable, a horizontally mounted motor 16, mounted sideways within the housing 14 to maintain an extreme low profile, and a non-centrally configured gearbox 68, non-central to a central axis of the cleaning disc 12, non-centrally configured to allow the sideways mounted motor 16 to be housed within, or substantially within a circumference of the cleaning disc 12, the device 10 thus maintaining both an extreme low profile and an extreme compact diametric profile. Preferably the housing 14 encapsulates the motor 16, forming a mounded pinchgrip 38 for gripping by a user. Preferably there is provided a pressure activated unit 62 so that pressurizing of the pinchgrip 38 activates the device 10, which is intended to provide an intuitive interface.

19 Claims, 7 Drawing Sheets

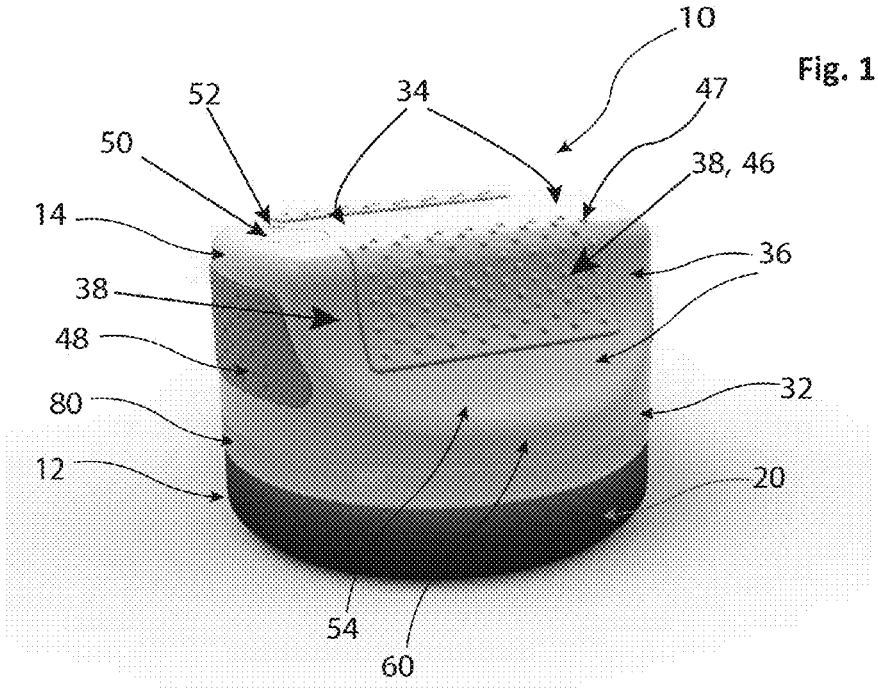
Fig. 1
Fig. 2
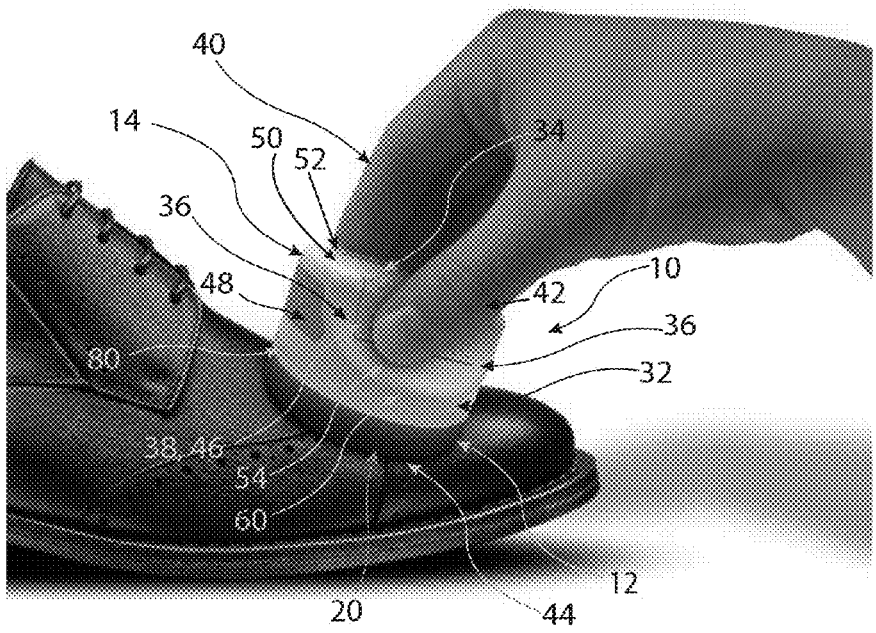

SHOE CLEANING DEVICE

CROSS REFERENCE TO RELATED APPLICATIONS

This application claims priority to application GB1017367.2, filed Oct. 14, 2010. This application also claims priority to application GB1113439.2, filed Aug. 4, 2011.

DEFINITION OF TERMS

For the purposes of the present application, the terms 'sideways mounted motor' and 'horizontally mounted motor' refer to a motor mounted perpendicular, or substantially perpendicular, to a rotational axis of a cleaning disc.

BACKGROUND

Shoes need to be polished.

Lack of polishing leads to untidiness, can ruin the look of a shoe, and leads to lessening of a lifespan of a shoe.

A shoe wearer has three choices;

One, they may polish by hand, using the old-fashioned method of a rag/brush and polish. For many, this is considered old-fashioned, a chore, messy, and time consuming.

Two, they may use an electric shoe polisher.

Electric shoe polishers require a significantly sized motor to produce output speeds and torque to adequately shine a shoe, therefore they are often bulky in size and/or shape.

Whichsoever direction the motor is aligned, the device extends significantly in that direction.

Size, in and of itself, is considered unattractive and creates disinterest in potential users. Users want a device that is small, portable, lightweight, and intuitive. Many devices come in cheap open-side plastic cases, rendering portability impractical or impossible. Furthermore many are not rechargeable.

The size, shape, and design of the devices often leads to awkward handling. Due to the size and shape, a user cannot grip the device with their fingers alone and adequately apply downward pressure to a surface of a shoe, whilst moving it about the shoe and retaining full control. Many devices require a user hold the device in the palm of a hand, rather than the fingers, which would be more preferable.

Typically devices have an ON/OFF button to activate rotation of a rotatable cleaning disc. This is not particularly interactive. Furthermore, the devices do not provide variable output responses or innovative features that add value to the user and to the experience of shining a shoe, such as lighting effects or technological features.

For these reasons, electric shoe polishers are seen as even more of a chore, and certainly less effective, than cleaning the shoe with a rag and polish. They have fallen well behind technologies in other personal hygiene and morning cleanliness sectors, such as electric toothbrushes and electric razors, which often have technological features, cutting edge design, and recharging portability aspects. As they have done so, interest in the sector has waned. With large and innovative companies recognising the lack of interest, for the most part only cheap imports remain, bringing with them still further inefficiency, lack of innovation, poor design, such as the use of cheap grey plastic materials, and cheap components.

For this reason, many people choose a third option; a portable non-electric sponge applicator, which has a squeezable housing so that a cleaning fluid inside may be squeezed onto the sponge and applied to the shoe. The problem is, a sponge applicator often does not shine the shoe. Instead of cleaning and buffing the shoe, it often applies a veneer of fluid agent that colours the surface of the shoe, thus coating it. Over time, this can affect the finish of the shoe, and is not suitable for high quality leather finishes.

The present invention seeks to provide a solution to these problems by providing, in accordance with a first aspect of the invention, a shoe cleaning device comprising a rotatable cleaning disc, a housing on which the cleaning disc is rotatably mountable, a horizontally mounted motor, mounted sideways within the housing to maintain an extreme low profile, and a non-centrally configured gearbox, non-central to a central axis of the cleaning disc, non-centrally configured to allow the sideways mounted motor to be housed within, or substantially within a circumference of the cleaning disc, the device thus maintaining both an extreme low profile and an extreme compact diametric profile.

The sideways mounted motor allows a relatively large motor to be provided, whilst maintaining an extreme low profile. Preferably the housing is approximately only 30 mm high, and may conveniently be less. In normal circumstances this would lead to a handle configuration for the housing, extending significantly in a direction the motor is aligned.

A non-centrally configured gearbox is provided, non-central to a central axis of the cleaning disc, the gearbox being routed back to a central axis by a preferably bevel gear solution. The device therefore does not extend significantly in any given direction and preferably forms a spinning disc shape, so that all components may be housed in a circular housing that has a substantially similar circumference to the cleaning disc, whilst retaining an extreme low profile, as well as an extreme compact diametric profile.

Preferably the housing encapsulates the motor and forms a mounded pinchgrip that may comprise a narrow plain and a scalloped recess each side of the motor. This provides an intuitive means of gripping and control for a user, who can grip the device simply by pinching the mounded pinchgrip and retain full control whilst applying downward pressure and moving over a shoe.

Preferably there is at least one pressure activated unit, which is more preferably activated by pressurizing the pinchgrip, so that a user can activate the device by pinching the grip, preferably between two fingers and a thumb, and with no added movement required, such as switching an ON/OFF button. This adds an intuitive and interactive aspect to the experience of shining a shoe.

Preferably there is provided an illuminatory power band that spans a circumference of the device in totality or in pattern. Pinching of the pinchgrip preferably activates the illuminatory power band simultaneously with activating the device. The illuminatory power band provides other variable output responses to a user, such as flashing when recharging is required, lighting in a preferably circlic sequence whilst recharging, and fully illuminating when recharging is complete.

This provides further intuitiveness, an innovative design feature, and adds value to a user, placing the device on a par with modern technology and providing a communicative interface between user and device.

Preferable and/or optional features of the first aspect of the invention are set forth in claims 2 to 18 inclusive.

According to a second aspect of the invention, there is provided a shoe cleaning system for a pressure activated, low lying, compact shoe cleaning device, the device employing a sideways mounted motor and non-centrally configured gearbox, non-central to a central axis of the cleaning disc, non-central so that the motor can be housed within, or substantially within, a housing of the device, thus facilitating an extreme low profile and extreme compact diametric profile for the device, the system for the device comprising: a storage container, itself comprising a cavity and a lid for closing the cavity; at least one polishing unit for applying to a shoe for polishing, the polishing unit comprising a container, and a polishing substance contained therein; at least one selectably interchangeable mountable cleaning discs; and a shoe cleaning device in accordance with a first aspect of the invention when it has preferable and/or optional features as set forth in claim 9.

According to a third aspect of the invention, there is provided a shoe cleaning device comprising: a rotatable cleaning disc; a housing on which the cleaning disc is rotatably mountable; a horizontally mounted motor, mounted sideways within the housing to maintain an extreme low profile; and non-centrally configured gearing, non-central to a central axis of the cleaning disc, non-centrally configured to allow the sideways mounted motor to be housed within, or substantially within, a circumference of the cleaning disc, the motor and gearing in combination extending over a central axis of the cleaning disc on a substantially horizontal plain, the device thus requiring a non-centrally configured gearing solution to rotate the cleaning disc about a central axis, the sideways mounted motor and the non-centrally configured gearing solution thus facilitating both an extreme low profile for the device, and an extreme compact diametric profile, and thus allowing a disproportionately large, and thus powerful, motor to be housed within an extremely compact low lying device.

The present invention will now be more particularly described, with reference to the accompanying drawings, by way of example only and in no way limiting the scope of the invention, in which:

FIG. 1 is a perspective view of a preferred embodiment of a shoe cleaning device, in accordance with a first aspect of the invention;

FIG. 2 shows the device in use;

Figure 3:
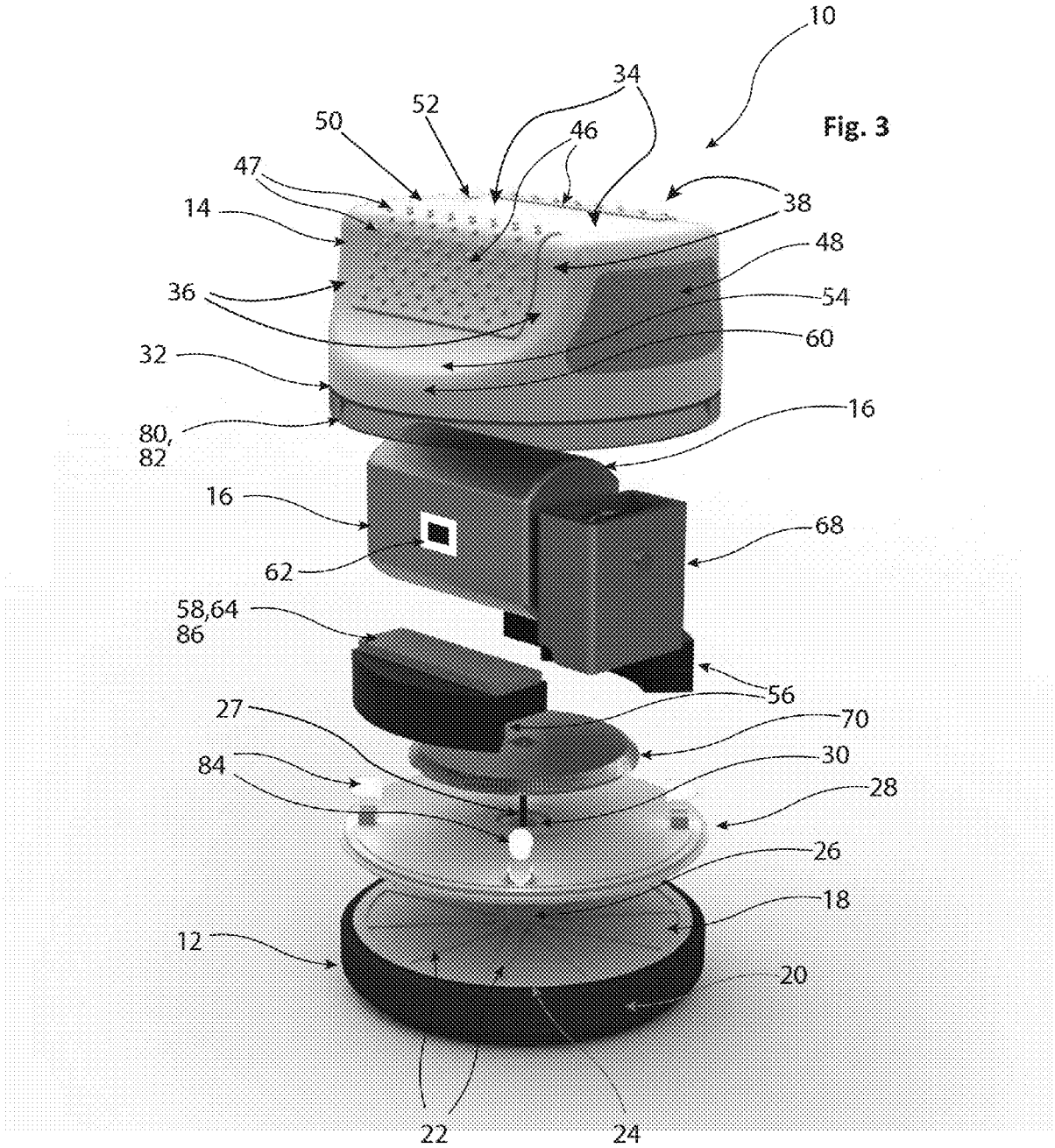
FIG. 3 is an exploded view of the device.

Referring to the drawings, and particularly referring to a preferred embodiment of the invention as depicted in FIG. 1, FIG. 2 and FIG. 3, there is shown a shoe cleaning device 10 which comprises a rotatable cleaning disc 12, a housing 14 on which the cleaning disc 12 is rotatably mountable, a horizontally mounted motor 16, mounted sideways within the housing 14 to maintain an extreme low profile, and a non-centrally configured gearbox 68, non-central to a central axis of the cleaning disc 12, non-centrally configured to allow the sideways mounted motor 16 to be housed within, or substantially within a circumference of the cleaning disc 12, the device thus maintaining both an extreme low profile and an extreme compact diametric profile.

Extreme low profile refers to an extreme low height of the device 10. Extreme compact diametric profile refers to an extremely compact diameter of the device 10.

The disc 12 has a, typically plastics, base 18 and a cleaning element 20. The base 18 may conveniently include radial spokes 22 that extend to a rim 24. The cleaning element 20 may be attached permanently to the, typically plastics, base 18 with resin or glue type materials, or may fit to the base 18 by overlapping the disc rim 24. In this way, it is feasible that a common base 18 may be used for selectable cleaning elements 20, which may reduce cost. In a preferred embodiment a base 18 is singular to each separate cleaning element 20, forming a cleaning disc 12 that is interchangeably selectably mountable.

The disc 12 may be mountable to the housing 14 via a central attachment point 26 that may attach to a central drive shaft 27. The drive shaft 27 may be sheathed or collared as it is received by the central attachment point 26, thus rotating the cleaning disc 12. The disc 12 and/or the cleaning element 20 may be hollowed at its centre as the outer perimeter of a rotating cleaning disc rotates at a higher speed.

The housing 14 has a base 28 that has a central aperture 30. There is shown a circular outer housing rim 32, the housing rim 32 having the same or substantially similar circumference as the disc 12. The housing 14 houses a horizontally mounted motor 16, mounted sideways within the housing to maintain an extreme low profile. The housing 14 encapsulates the motor 16, thus forming a narrow plain 34 on top of the motor 16 and a scalloped recess 36 on either side of the motor 16. The narrow plain 34 and the scalloped recess 36 together form a mounded pinchgrip 38 that a user may pinch between their fingers 40, or, most preferably, between two fingers 40 and a thumb 42. As shown in FIG. 2, the user may thus pinch the mounded pinchgrip 38, operating the device and simultaneously applying downward pressure to a shoe surface 44.

Preferably on either side of the mounded pinchgrip 38 there is provided a, preferably rubberized, layer of higher friction material 46 or a higher friction surface, which aids gripping of the shoe cleaning device 10. The higher friction material 46 may have pips or projections 47 to further aid gripping of the device 10. A second higher friction material layer 48 or higher friction surface may be provided on opposing ends of the narrow plain 34 so that a user may grip the shoe cleaning device 10 without squeezing the mounded pinchgrip 38.

A depressible booster button 50 is conveniently located on top of the narrow plain 34, and a lighting means 52 beside the booster button 50 indicates its activation. It is feasible that other means of boosting the speed of the rotatable cleaning disc 12 may be provided, such as buttons or switch members, which will be apparent to persons with skill in the art.

The scalloped recess 36 arcuates to a raised housing portion 54, in which various housing components reside, there being housed a, preferably lithium ion rechargeable, battery 56 and a PCB 58. The battery 56 may be present within both raised housing portions 54, either separately offering power to the shoe cleaning device 10 or centrally linked, thus forming one battery unit. Lithium ion battery constitution allows for batteries to be of unorthodox shape, thus aiding efficiency of the device 10 by maximising the shape and power of a battery 56 to fit within the housing 14.

The raised housing portion 54 conveniently tapers round to the housing rim 32 via an arcuate curve 60.

Pinching of the mounded pinchgrip 38 by a user may activate the motor 16 and therefore the shoe cleaning device 10 via pressure to a pressure activated unit 62 which may conveniently be attached to a side of the motor 16. This is controlled by an activation circuit 64. Differential pressure to the pinchgrip 38 by a user may result in differential speed or power output to the cleaning disc 12.

The horizontally mounted motor 16 has a motor drive shaft 66 which is non-central to a central axis of the cleaning disc 12, thus requiring a non-centrally configured gearbox 68. The gearbox 68 forms a gearing solution that includes a, preferably bevel or crown, gear 70 that routes the axis of rotation back to a central axis via a non-central geartooth connection 71 thus rotating the rotatable cleaning disc 12. The, preferably bevel or crown, gear 70 may be internal or external to the housing 14.

It is feasible that the cleaning disc base 18 has a gear tooth configuration 72 that receives a, preferably bevel, non-central gear 74 from the non-centrally configured gearbox 68 via a non-central aperture 76 in the housing base 28. In this case, the cleaning disc 12 may be mountable to the housing base 28 via a free spinning axial shaft 78 that may be sheathed or collared, the disc itself acting as a gear.

In a preferred embodiment, the housing features an illuminatory power band 80 that spans a circlic circumference of the device 10 and comprises a, preferably plastics, outer screen 82 and multiple LED lights 84 that are controlled by a lighting circuit 86. It is feasible that it may be lighted by other means that will be apparent to those skilled in the art. It may span the circumference of the device 10 in totality or in pattern, and offers variable feedback responses that significantly add to the intuitiveness of the device 10. As is shown in FIG. 1 and FIG. 2, the illuminatory power band 80 provides illumination when the device 10 is activated, preferably via pinching of a mounded pinchgrip 38 wherein there is a pressure activated unit 62 that may relay an electrical signal to an activation circuit 64 and a lighting circuit 86.

Preferably the illuminatory power band 80 provides further feedback such as flashing during use to indicate the device 10 requires recharging, and separate lighting members 84 and/or illuminating members 104 lighting in a, preferably circlic, sequence to denote when the device 10 is recharging.

Figure 4:
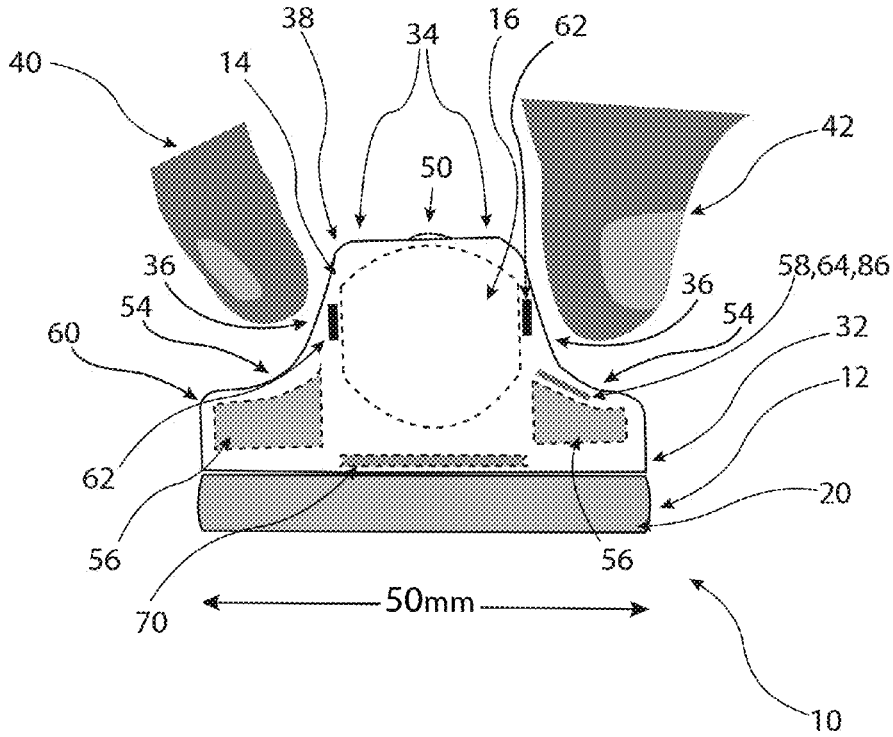
FIG. 4 is a transparented view of a mounded pinchgrip as it is pinched.

Referring to FIG. 4 there is shown the shoe cleaning device 10 as the mounded pinchgrip 38 is being pinched by a user. At least one pressure activated unit 62 is conveniently attached to the motor 16 so that pressurizing of the mounded pinchgrip 38 may activate the device 10. The device 10 is approximately 50 mm in diameter, extremely compact for a shoe cleaning device, and more preferably 48 mm. Thus the device 10 maintains an extreme compact diametric profile. The housing 10 is approximately 30 mm in height, more preferably 27 mm; an extremely compact height for a shoe cleaning device. Thus the device 10 maintains an extreme low profile, with the cleaning disc 12 preferably being approximately 8 mm in height. In this way, the horizontally mounted motor 16 achieves an extreme low profile for a shoe cleaning device, without which the mounded pinchgrip 38 would become unintuitive.

The raised housing portion 54 defines a compartment that includes a lithium ion battery 56 and a PCB 58. The motor 16 drives the cleaning disc 12 via a non-centrally configured gearbox 68, which is not shown in FIG. 4, and a, preferably bevel or crown, gear 70 that is central to a central axis of the cleaning disc 12.

Figure 5:
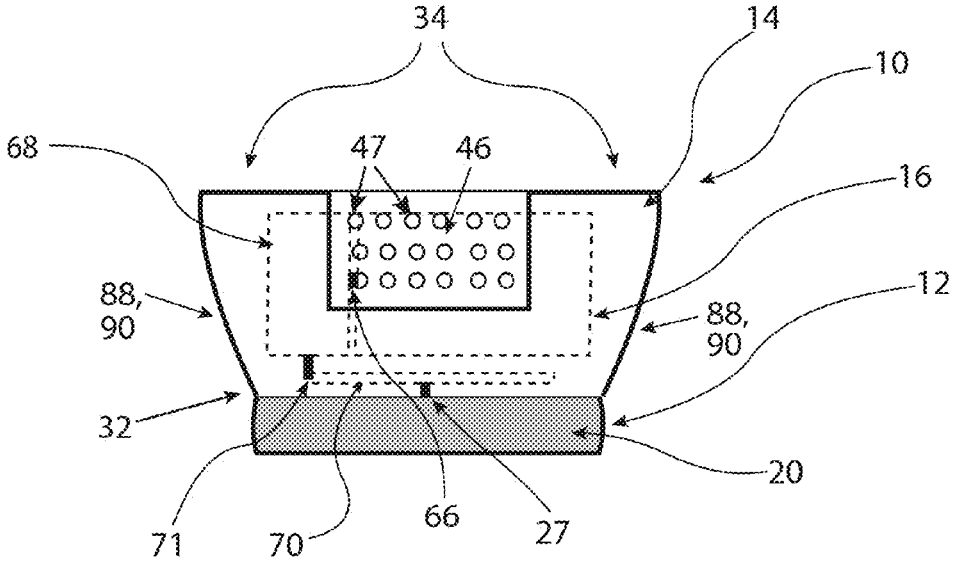
FIG. 5 is a transparented view of a sideways mounted motor and non-central gear solution in an embodiment where a rim of a housing of the shoe cleaning device is arced.
Figure 6:
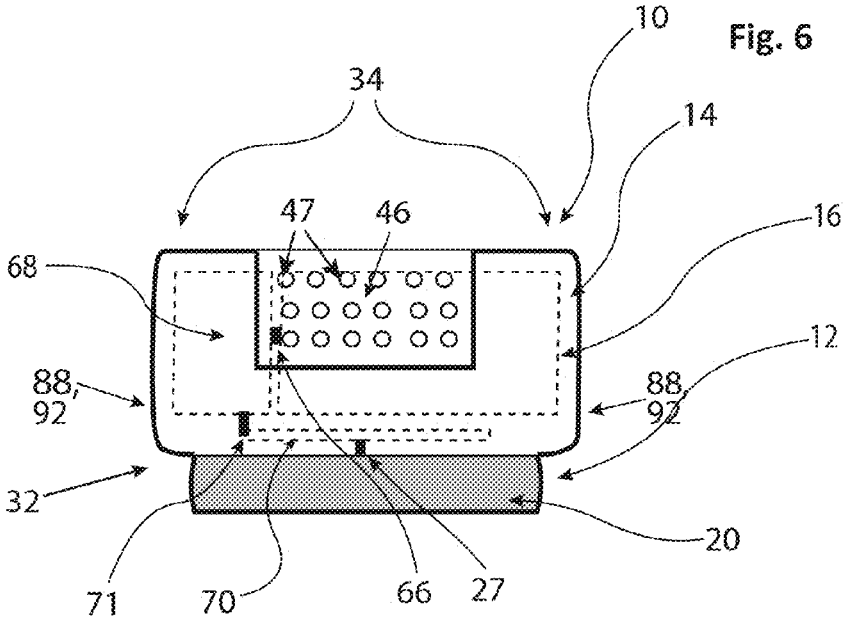
FIG. 6 is a transparented view of the sideways mounted motor and non-central gear solution in an embodiment where a rim of a housing of the shoe cleaning device is rotunded.

Referring to FIG. 5 and FIG. 6, there is shown a transparented side view of the device 10. The housing rim 32 extends just beyond the circlic circumference of the cleaning disc 12 and retains a substantially similar circumference to the cleaning disc 12. A slight protrusive rim 88 extends from the base of the housing rim 32. In FIG. 5 the protrusive rim 88 tapers to form an arced rim 90. In FIG. 6 the protrusive rim 88 forms a straighter or more rotunded outer edge 92.

The horizontally mounted motor 16 connects to a non-centrally configured gearbox 68 that, via a non-central geartooth connect 71, drives a, preferably bevel or crown, gear 70. The gear 70 has a central output shaft 27 that attaches to the cleaning disc 12, thus rotating it.

In the case of both FIG. 5 and FIG. 6, and particularly referring to FIG. 6, the sideways mounted motor 16 and non-centrally configured gearbox 68 may partially extend beyond the circlic circumference of the cleaning disc 12. Nonetheless, a sideways mounted motor 16 is housed within, or substantially within a circumference of the cleaning disc 12, the device 10 thus maintaining both an extreme low profile and an extreme compact diametric profile via the use of a non-centrally configured gearbox 68, non-central to a central axis of the cleaning disc 12. In such an embodiment, the device 10 may be oblong or rectangular in shape. Preferably the mounded pinchgrip 38 is retained. It is feasible that the mounded pinchgrip 38 may not be retained, although this may increase the girth of the device 10.

Figure 7:
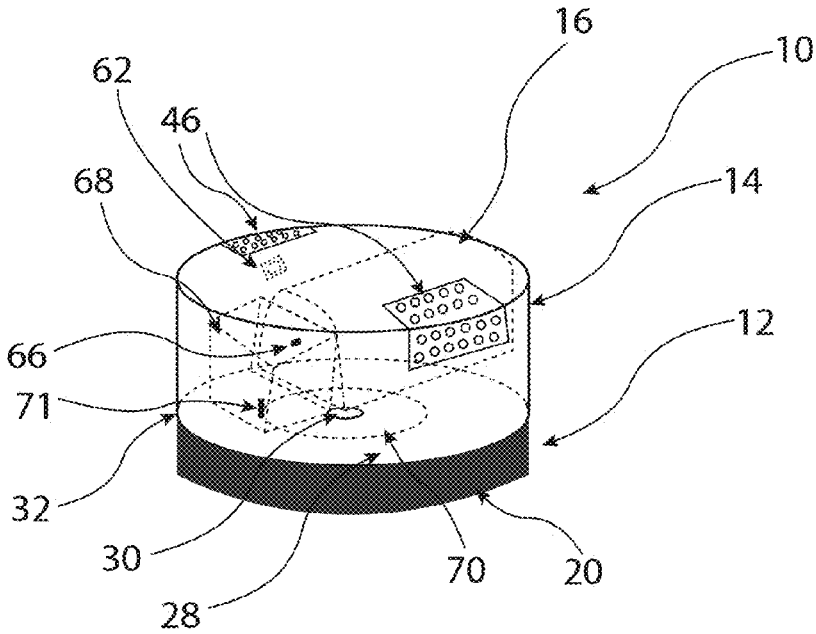
FIG. 7 shows the horizontally mounted motor in a housing with no mounded pinchgrip.

Referring to FIG. 7, there is shown an embodiment of the invention that comprises a rotatable cleaning disc 12, a housing 14 on which the cleaning disc 12 is rotatably mountable, a horizontally mounted motor 16, mounted sideways within the housing 14 to maintain an extreme low profile, and a non-centrally configured gearbox 68, non-central to a central axis of the cleaning disc 12, non-centrally configured to allow the sideways mounted motor 16 to be housed within, or substantially within a circumference of the cleaning disc 12, the device 10 thus maintaining both an extreme low profile and an extreme compact diametric profile. The motor 16 drives the cleaning disc 12 via a non-centrally configured gearbox 68 that, via a non-central geartooth connect 71, drives a, preferably bevel or crown, gear 70. The gear 70 has a central output shaft 27 that attaches to the cleaning disc 12, thus rotating it. The central output shaft 27 attaches to a central attachment point 26 of the cleaning disc 12 and may be sheathed or collared.

A, preferably rubberized, higher friction material 46 may conveniently be provided at opposing ends of the housing 14, denoting to a user where to grip and aiding grip therein, whilst providing a makeshift pinchgrip. The pinchgrip may be depressible, thus activating the device 10 via at least one pressure activated unit 62.

Figure 8:
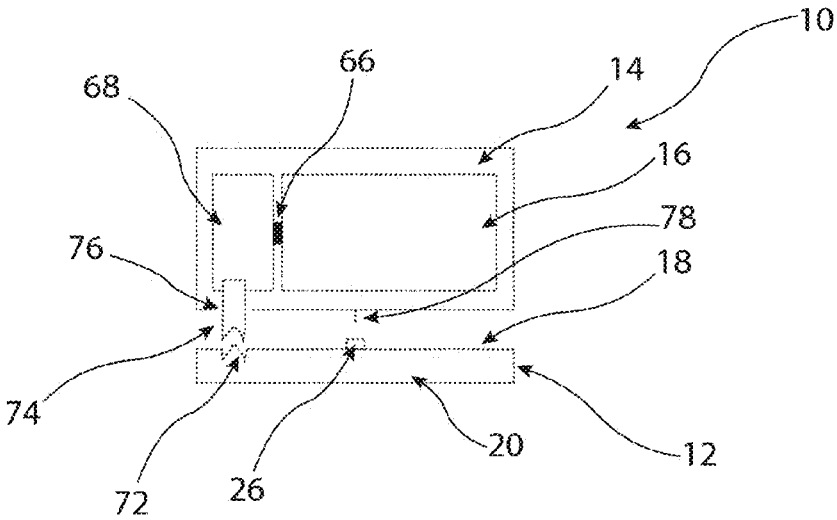
FIG. 8 shows an embodiment of the invention where a non-central gear attaches directly to a disc.

Referring to FIG. 8, there is shown an embodiment of the device 10 which comprises a rotatable cleaning disc 12, a housing 14 on which the cleaning disc 12 is rotatably mountable, a horizontally mounted motor 16, mounted sideways within the housing 14 to maintain an extreme low profile, and a non-centrally configured gearbox 68, non-central to a central axis of the cleaning disc 12, non-centrally configured to allow the sideways mounted motor 16 to be housed within, or substantially within a circumference of the cleaning disc 12, the device 10 thus maintaining both an extreme low profile and an extreme compact diametric profile. The device 10 may feature a mounded pinchgrip 38 or may have a substantially circlic housing shape as shown in FIG. 7.

The motor 16 connects to a non-centrally configured gearbox 68 but a central gear 70 is foregone in favour of a, preferably bevel, non-central gear 74 that protrudes through a non-central aperture 76 in the housing base 28. The cleaning disc base 18 has a gear tooth configuration 72 that receives the non-central gear 74 from the non-centrally configured gearbox 68.

Foregoing the central gear 70 may allow for a furthering of the extreme low profile of the device 10.

The cleaning disc 12 acts as an external gear, and attaches to the housing via a free spinning central shaft 78 which may attach to a central attachment point 26 of the disc 12. The free spinning central shaft 78 may be sheathed or collared or of any shape. A disc 12 may be attachable or, in a similar embodiment, a disc 12 may form an integral part of the housing 14, being fixedly attached to the free spinning central shaft 78 and also the non-central gear 74 via a gear tooth configuration 72, so that a separate cleaning disc 12 or cleaning element 20 may be removably clippable and/or attachable to the disc 12.

The non-central gear 74 is preferably bevel, though not limited to being a bevel gear solution, as will be apparent to persons skilled in the art.

Figure 9:
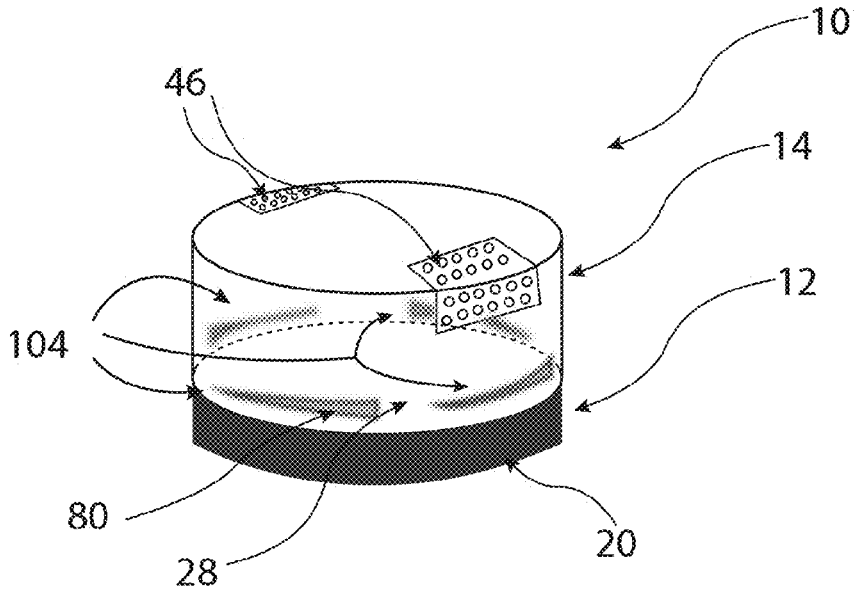
FIG. 9 is a perspective view where an illuminatory power band spans a circumference of the device in pattern.
Figure 10:
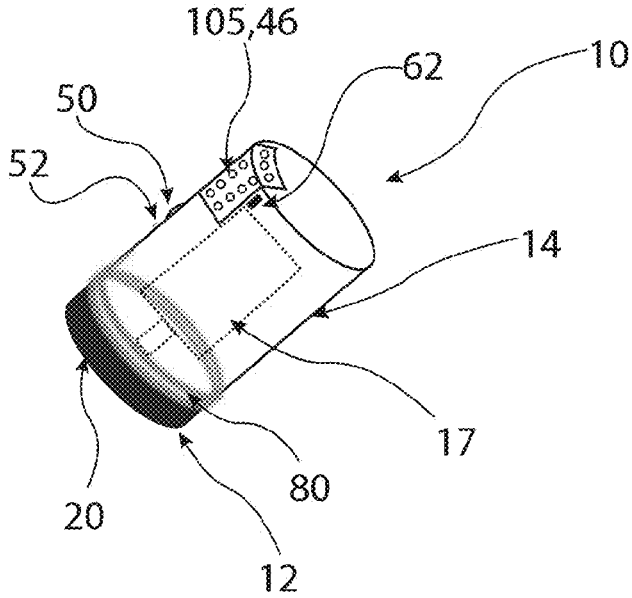
FIG. 10 is a perspective view where an illuminatory power band spans a circumference of the device in totality.

Referring to FIGS. 9 and 10, there is provided an illuminatory power band 80 that spans a circlic circumference of the device 10. Referring to FIG. 10, it spans the circumference in totality. Referring to FIG. 9, it spans the circumference in pattern, wherein separate illuminating members 104 are able to light in a sequence, thus performing the function of an illuminatory power band 80 that spans a circlic circumference in totality. In this separate illuminating member 104 configurement, there are preferably at least two illuminating members 104, and more preferably four. It is feasible that one large illuminating member 104 that does not span a circumference of the device 10 may act as a variable feedback illuminatory power band 80, in which case it is of at least 16 mm in dimension, more preferably at least 25 mm. Alternatively a pair or any number of multiple illuminating members and/or strips may be provided. Thus the cleaning device has an illuminatory power band that is at least one of: arranged in pattern; cyclic; greater than 16 mm in length; of multiple illuminating members.

Particularly if coupled with a pressure activated unit, this creates an interactive variable feedback response electric shoe cleaning device, whereby a user interacts both with the function of the device and/or the illuminatory power band via the pinchgrip. The illuminatory power band communicates states of the invention, such as use, requirement of charging, via various displays of illumination.

Referring to FIG. 10, there is shown the illuminatory power band 80 where a vertical motor 17 is vertically mounted, thus not requiring a non-centrally configured gearbox, 68, the housing 14 forming a tube. An illuminatory power band 80 is provided that spans a circumference of the device 10 in totality, offering variable feedback responses as hereinbefore described. The housing 14 may feature a grip 105, which may conveniently have higher friction materials 46 or a higher friction surface to aid gripping by a user. The device 10 may feature a pressure activated unit 62 so that pressurising of the grip 105 may activate the device, thus activating rotation of the rotatable cleaning disc 12. Preferably the pressurising of the grip 105 also activates the illuminatory power band 80. A booster button 50 or switch member may feature on the housing 14, which may also feature a lighting means 52 which indicates its activation. Downward pressure may be exerted by a user as the device 10 is placed on and moved around a user's shoe. Variations of the embodiment may be provided that will be apparent to persons skilled in the art, such as a pressure activated grip 105 being provided on the top of the housing 14.

The illuminatory power band 80 offers variable feedback responses that significantly add to the intuitiveness of the device 10. As is shown in FIG. 1 and FIG. 2, the illuminatory power band 80 provides illumination when the device 10 is activated, preferably via pinching of a mounded pinchgrip 38 wherein there is a pressure activated unit 62 that may relay an electrical signal to an activation circuit 64 and a lighting circuit 86, or by any other electrical means of lighting a member.

Preferably the illuminatory power band 80 provides further feedback such as flashing during use to indicate the device requires recharging, and separate lighting members 84 and/or illuminating members 104 lighting in a, preferably circlic, sequence to denote when the device 10 is recharging.

Figure 11:
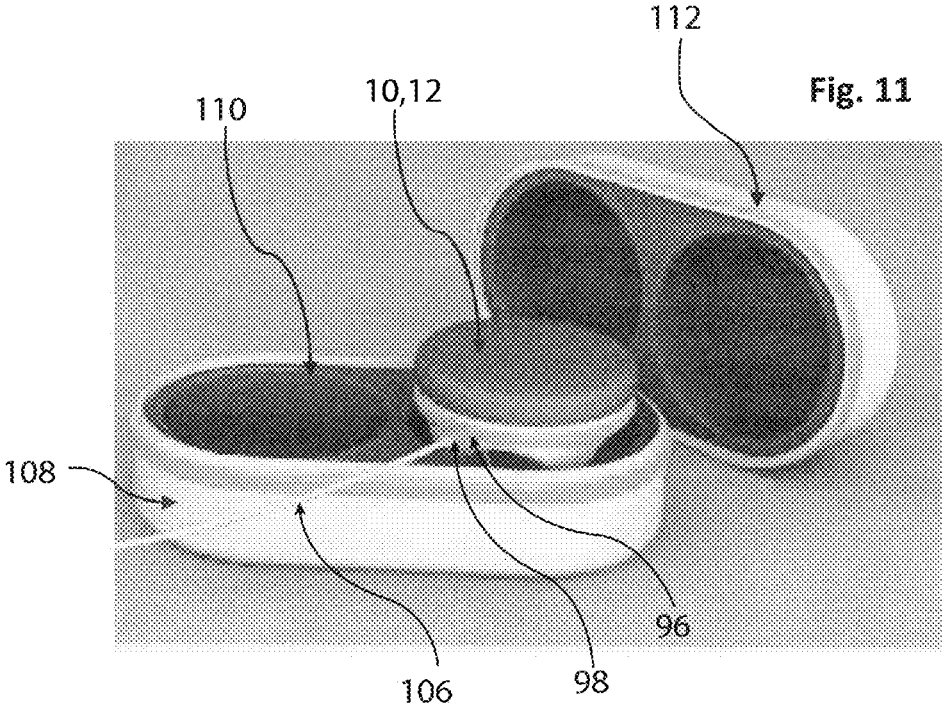
FIG. 11 shows a storage container for the device.

Referring to FIG. 11, there is provided a recharging jack 98 for an input socket 96. The jack 98 may have a cable 106 so that the device 10 can be recharged via a mains electricity output or any other power output. The device 10 may be wirelessly rechargeable.

There is provided a storage container 108 which comprises a cavity 110, a lid 112 for closing the cavity 110, and a shoe cleaning device 10 substantially as hereinbefore described. The configuration of the container 108 is shown by way of example only. A container 108 may be of similar size to the embodiment here shown, and may have a different cavity 110 configuration, for example multiple cavities 110 to contain multiple shoe cleaning device accessories as well as the device 10.

Figure 12:
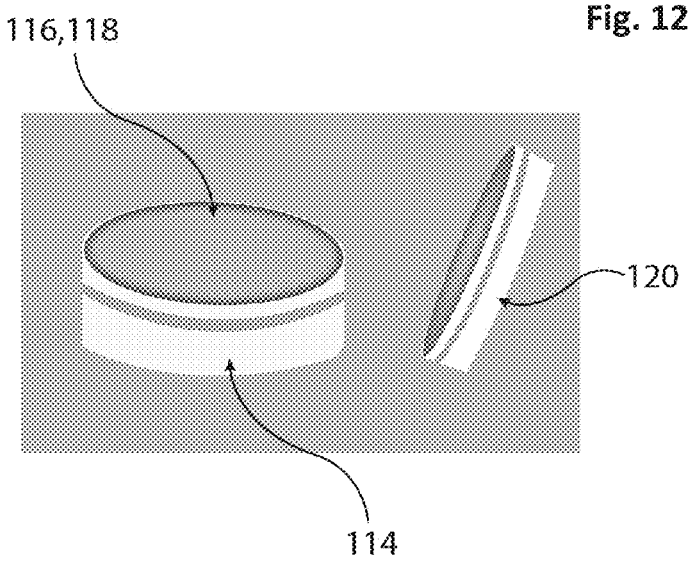
FIG. 12 shows a polishing unit container.

Referring to FIG. 12, there is provided a polishing unit container 114 which comprises a cavity 116, a polishing substance 118 and a lid 120 for closing the cavity, for use with a shoe cleaning device 10 substantially as hereinbefore described. The polishing substance may feasibly be a fluid spray, in which case, the polishing unit container 114 may be a spray container. Preferably the container 114 is of plastics materials and the lid 120 may screw to the base of the container 114, although it may open/close by any method.

In use, the device 10 is picked up via the mounded pinchgrip 38, with a cleaning disc 12 being selected by the user, the cleaning disc 12 being one of a polishing disc, a buffing disc, and a brushing disc. A polishing substance 118 is applied to the cleaning element 20 by the user, although it is feasible a spray polish may be directly sprayed to a shoe. The polish may be a wax, a spray, or any other cleaning agent for a shoe. The device 10 may be twisted by the user on contact with the polishing substance 118 so that polish is applied to the disc 12. The device 10 may be gripped at adjacent ends to the mounded pinchgrip 38 preferably via a second higher friction materials 48 that aid gripping of the device 10. This avoids activation of the device 10 which is preferably activated by pinching the pinchgrip 38.

A polishing disc is selected for polishing, a buffer disc for buffing, preferably after polishing, and a brushing disc is selected to remove dirt and particulate material that may prevent thorough shining of the shoe by the polishing disc. The brushing disc may feature bristles. A sprayer may be provided so that a water based fluid may be sprayed to the shoe to aid cleaning. In this way, a soccer boot, a golf shoe, or a walking boot may be cleaned and may also be prepared for polishing and buffing.

Different colour polishing discs may be provided for different colour polishes and shoes, such as brown or black. The appropriate disc 12 is attached to a central drive shaft 27. The mounded pinchgrip 38 is preferably pinched by two fingers 40 and a thumb 42. Pressure can thus be exerted directly downwards onto a shoe surface 44 as it is placed on and around a user's shoe whilst retaining intuitive and perfect control of the device 10 simply by pinching.

If more polish 118 is required, the device 10 may again be pinched by the user at the opposing ends of the mounded pinchgrip 38, aided by the second higher friction material 48 or higher friction surface. Thus polish 118 can easily be applied to the device 10 by a user during the act of cleaning a shoe.

The selected disc 12 may be unselected and detached by the user by various means that will be apparent to persons skilled in the art, such as unclipping. It may be possible for a disc 12 to be selectably attached by a user simply by applying pressure to it at an angle by which a central drive shaft 27 is received by a central attachment point 26, so that the disc 12 need never be held by the user.

The device 10 is preferably activated by pinching of the mounded pinchgrip 38 by the user, which preferably illuminates an illuminatory power band 80.

An ON/OFF button may feature on the housing 14. Preferably it is not provided as the device 10 is activated by pressure to the mounded pinchgrip 38.

A booster button/switch member 50 may be pressed by the user to generate extra rotational speed for the cleaning disc 12. This may be particularly used for buffing. The combination of a softer buffing disc material, with increased rpm of the cleaning disc 12, and feasibly a fluid spray that is sprayed on to the shoe surface 44 may add shine to the shoe.

After use, the shoe cleaning device is stored in a container 108 which comprises a cavity 110 and a lid 112 for closing the cavity. The container 108 has at least one cavity, which cavities may be used to store at least one selectably mountable discs 12, at least one shoe polishing unit container 114 which comprises a cavity 116, a polishing substance 118 and a lid 120 for closing the cavity, and a shoe cleaning device 10 as hereinbefore described. Other accessories may be included.

The container 108 closes, and, along with the compactness of the device 10, made possible by the horizontally mounted motor 16, allows full portability of the device 10 with polishing accessories. Preferably the lid 112 clips to the base of the container 108 or is magnetically attachable.

The device 10 is recharged by the user either via a recharging jack 98, or wirelessly, which may activate a relevant lighting sequence from the illuminatory power band. Preferably the battery 56 offers at least 10 minutes use when fully recharged, or significantly more, thus ensuring the portability of the device 10.

The sideways mounted motor with a non-centrally configured gearbox creates an extreme low profile and an extremely compact diameter. In an embodiment without the central gear, the housing may be as low as approximately 25 mm; in a preferred embodiment which comprises the gear, approximately 30 mm.

The mounded pinchgrip offers unparalleled control and interface of the device, allowing a user to pick up the device, apply pressure to a surface, and move the device about a surface whilst retaining complete control of the device, preferably holding with just two fingers and a thumb.

The higher friction layer aids grip of the device and enhances it.

The pressure activated unit offers a surprising and interactive interface for the user and further enhances the mounded pinchgrip which, on top of the aforementioned abilities, allows a user to activate the device without the need for an ON/OFF button, further enhancing the intuitiveness and accessibility of the device.

The illuminatory power band offers unparalleled feedback for a shoe cleaning device by providing a communicative interface.

The device may come in differing colours, such as a black matt finish with a green illuminatory power band or in colours which may be gender specific, such as a white plastic finish with a pink power band.

All features combined, the device offers a unique interface that is personalised, communicative and puts the shoe cleaning device 10 on a par with other technologies in the personal grooming sector.

The device is compact, lightweight and striking, having the appearance of simply being a spinning disc, which is attractive to consumers. This, added to a stylised and close-lid container, and a rechargeable function, makes the device extremely portable, so that a user can easily place the container in a coat pocket, or even a trouser pocket. The design and technical features mean that, for the first time, a user can shine their shoes with a portable electric shoe cleaning device that is highly efficient, and on a par with modern technology.

Due to the extreme compactness and portability of the device, accessories such as polishing unit containers and cleaning discs can be carried in the storage container, whilst retaining portability. Preferably the polishing unit containers are of plastics materials, remaining lightweight. With the configuration of the opposing ends of the mounded pinchgrip that are not pressure-activated, and preferably have a layer of higher friction material to aid gripping, a user can apply polish without being concerned of getting polish on their hands—a key concern to many potential buyers, who perceive shoe shining to be a messy pastime. A clippable attachment means for the discs may further enhance efficacy.

The combination of the illuminatory power band, the pressure activated unit, the aforementioned technological features, and the compact size and design of the invention creates the first interactive variable feedback response shoe cleaning system, which a user may transport easily via a storage container unit that fits inside a coat or trouser pocket.

The embodiments described above are provided by way of example only, and various other modifications will be apparent to persons skilled in the art without departing from the scope of the invention as defined by the appended claims.

The invention claimed is:

1. A shoe cleaning device comprising:

a rotatable cleaning disc;

a housing on which the cleaning disc is rotatably mountable;

a horizontally mounted motor, mounted sideways within the housing to maintain an extreme low profile; and a non-centrally configured gearbox, non-central to a central axis of the cleaning disc, non-centrally configured to allow the sideways mounted motor to be housed within, or substantially within, a circumference of the cleaning disc, the device thus maintaining both an extreme low profile and an extreme compact diametric profile.

2. A shoe cleaning device as claimed in claim 1, wherein there is provided a centrally configured gear, central to a central axis of the cleaning disc, that facilitates rotation of the disc.

3. A shoe cleaning device as claimed in claim 1, wherein there is provided a non-central gear that protrudes through a non-central aperture in a base of the housing, the gear being attachable to a gear tooth configuration on a base of the disc, thus rotating the disc, the disc being attachable to a free-spinning central shaft.

4. A shoe cleaning device as claimed in claim 1, wherein there is provided a non-central gear that protrudes through a non-central aperture in a base of the housing, the non-central gear being attachable to a fixedly attached disc that is an integral part of the housing and rotates about a free spinning central shaft, the cleaning disc being selectably attachably mountable to the fixedly attached disc, and thus rotatable.

5. A shoe cleaning device as claimed in claim 1, wherein the housing encapsulates the motor to form a mounded pinchgrip for gripping between a user's fingers, the mounded pinchgrip comprising a narrow plain and a scalloped recess on either side of the narrow plain, the mounded pinchgrip thus configured so that the device can be gripped by a user via pinching the pinchgrip with opposing force to the scalloped recesses either side of the narrow plain, so that the device can be neatly pinched and held by the user whilst simultaneously applying downward pressure to a surface for cleaning.

6. A shoe cleaning device as claimed in claim 2, wherein the housing encapsulates the motor to form a mounded pinchgrip for gripping between a user's fingers, the mounded pinchgrip comprising a narrow plain and a scalloped recess on either side of the narrow plain, the mounded pinchgrip thus configured so that the device can be gripped by a user via pinching the pinchgrip with opposing force to the scalloped recesses either side of the narrow plain, so that the device can be neatly pinched by the user whilst simultaneously applying downward pressure to a surface for cleaning.

7. A shoe cleaning device as claimed in claim 3, wherein the housing encapsulates the motor to form a mounded pinchgrip for gripping between a user's fingers, the mounded pinchgrip comprising a narrow plain and a scalloped recess on either side of the narrow plain, the mounded pinchgrip thus configured so that the device can be gripped by a user via pinching the pinchgrip with opposing force to the scalloped recesses either side of the narrow plain, so that the device can be neatly pinched by the user whilst simultaneously applying downward pressure to a surface for cleaning.

8. A shoe cleaning device as claimed in claim 4, wherein the housing encapsulates the motor to form a mounded pinchgrip for gripping between a user's fingers, the mounded pinchgrip comprising a narrow plain and a scalloped recess on either side of the narrow plain, the mounded pinchgrip thus configured so that the device can be gripped by a user via pinching the pinchgrip with opposing force to the scalloped recesses either side of the narrow plain, so that the device can be neatly pinched by the user whilst simultaneously applying downward pressure to a surface for cleaning.

9. A shoe cleaning device as claimed in claim 1, wherein there is provided at least one pressure activated unit so that pressurising of the unit activates the device, thus rotating the rotatable cleaning disc.

10. A shoe cleaning device as claimed in claim 5, wherein there is provided at least one pressure activated unit so that pressurising of the unit activates the device, thus rotating the rotatable cleaning disc, the pressure activated unit being provided about the mounded pinchgrip so that the device is activatable via pinching of the mounded pinchgrip by a user, the device thus being configured so that it can be all of:

- securely gripped and held via pinching with opposing force the scalloped recesses on either side of the narrow plain of the pinchgrip;
- downwardly pressed on a surface for cleaning by the user whilst retaining a secure hold of the device as aforementioned;
- activated simultaneously as the above via pinching the mounded pinchgrip with opposing force, the force activating the device via the pressure activated unit.

11. A shoe cleaning device as claimed in claim 10, wherein there is provided a higher friction surface on the mounded pinchgrip to aid gripping and pinching, the higher friction surface being located substantially on the scalloped recesses.

12. A shoe cleaning device as claimed in claim 9, wherein there is provided on the device a booster selecting element to boost speed of the rotatable cleaning disc, the device being configured to boost the speed of rotation for the cleaning disc when the booster selecting element is selected.

13. A shoe cleaning device as claimed in claim 10, wherein there is provided on the device a booster selecting element to boost speed of the rotatable cleaning disc, the device being configured to boost the speed of rotation for the cleaning disc when the booster selecting element is selected.

14. A shoe cleaning device as claimed in claim 13, wherein there is provided on the device a lighting element to denote activation of the booster, the device being configured to light the lighting element when the rotation for the cleaning disc is boosted via the booster selecting element.

15. A shoe cleaning device as claimed in claim 1, wherein the cleaning disc comprises at least a cleaning element, the cleaning element being substantially circular in shape, having one side configured for cleaning of a shoe, and an opposing side configured for attaching, the cleaning disc thus being rotatable for cleaning of a shoe.

16. A shoe cleaning device as claimed in claim 1, wherein the gearbox is a set of gears, the set of gears oriented on an axis that is not central to a central axis of the cleaning disc, thus facilitating housing of a disproportionately large, and thus powerful, motor within an extreme compact low lying shoe cleaning device.

17. A shoe cleaning device as claimed in claim 10, wherein a plurality of different discs are provided, the discs being selectably interchangeably mountable and at least one of a polishing disc, a buffing disc, and a brushing disc.

18. A shoe cleaning system for a pressure activated, low lying, compact shoe cleaning device, the device employing a sideways mounted motor and non-centrally configured gearbox, non-central to a central axis of the cleaning disc, non-central so that the motor can be housed within, or substantially within, a housing of the device, thus facilitating an extreme low profile and extreme compact diametric profile for the device, the system for the device comprising:

- a storage container comprising a cavity and a lid for closing the cavity;
- at least one polishing unit for applying to a shoe for polishing, the polishing unit comprising a container, and a polishing substance contained therein;
- at least one selectably interchangeable mountable cleaning discs; and
- a shoe cleaning device as claimed in claim 9.

19. A shoe cleaning device, comprising:

- a rotatable cleaning disc;
- a housing on which the cleaning disc is rotatably mountable;
- a horizontally mounted motor, mounted sideways within the housing to maintain an extreme low profile; and
- non-centrally configured gearing, non-central to a central axis of the cleaning disc, non-centrally configured to allow the sideways mounted motor to be housed within, or substantially within, a circumference of the cleaning disc, the motor and gearing in combination extending over a central axis of the cleaning disc on a substantially horizontal plain, the device thus requiring a non-centrally configured gearing solution to rotate the cleaning disc about a central axis, the sideways mounted motor and the non-centrally configured gearing solution thus facilitating both an extreme low profile for the device, and an extreme compact diametric profile, and thus allowing a disproportionately large, and thus powerful, motor to be housed within an extremely compact low lying device.

* * * * *